US009614294B2

(12) United States Patent
Koga et al.

(10) Patent No.: US 9,614,294 B2
(45) Date of Patent: Apr. 4, 2017

(54) ANTENNA DEVICE

(71) Applicant: FUJITSU LIMITED, Kawasaki-shi, Kanagawa (JP)

(72) Inventors: Yohei Koga, Kawasaki (JP); Hiroyuki Egawa, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 10 days.

(21) Appl. No.: 14/739,679

(22) Filed: Jun. 15, 2015

(65) Prior Publication Data

US 2016/0020527 A1 Jan. 21, 2016

(30) Foreign Application Priority Data

Jul. 15, 2014 (JP) ..... 2014-144999

(51) Int. Cl.
*H01Q 21/00* (2006.01)
*H01Q 21/30* (2006.01)
(Continued)

(52) U.S. Cl.
CPC ..... *H01Q 21/30* (2013.01); *H01Q 1/48* (2013.01); *H01Q 5/385* (2015.01); *H01Q 9/16* (2013.01); *H01Q 9/42* (2013.01); *H01Q 1/243* (2013.01)

(58) Field of Classification Search
CPC ..... H01Q 9/16; H01Q 21/30; H01Q 5/385; H01Q 1/48; H01Q 9/42; H01Q 1/243
(Continued)

(56) References Cited

U.S. PATENT DOCUMENTS

2004/0066341 A1 4/2004 Ito et al.
2004/0108957 A1 6/2004 Umehara et al.
(Continued)

FOREIGN PATENT DOCUMENTS

JP 2002-271118 A 9/2002
JP 2003-198410 A 7/2003
(Continued)

OTHER PUBLICATIONS

Lin, "Multiband Folded Planar Monopole Antenna for Mobile Handset", IEEE Transactions on Antennas and Propagation, Jul. 2004, vol. 52, No. 7, pp. 1790-1794.
(Continued)

*Primary Examiner* — Jean B Jeanglaude
(74) *Attorney, Agent, or Firm* — Arent Fox LLP

(57) ABSTRACT

An antenna device includes a ground; a monopole antenna including a first section running from a feeding point along the ground, a second section running in a direction away from the ground, and a third section running along the ground, the monopole antenna having a length corresponding to ¼ of a wavelength at a first resonance frequency; a parasitic element including a first section whose end is connected to the ground in the vicinity of the end of the first section of the monopole antenna and that runs in a direction away from the ground, and a second section, the parasitic element having a length corresponding to ¼ of a wavelength at a second resonance frequency; and a dipole antenna provided along the third section of the monopole antenna and the parasitic element, the dipole antenna having a length corresponding to ½ of a wavelength at a third resonance frequency.

11 Claims, 18 Drawing Sheets

(51) Int. Cl.

| | |
|---|---|
| ***H01Q 1/48*** | (2006.01) |
| ***H01Q 9/42*** | (2006.01) |
| ***H01Q 5/385*** | (2015.01) |
| ***H01Q 9/16*** | (2006.01) |
| *H01Q 1/24* | (2006.01) |

(58) Field of Classification Search
USPC ..... 343/793, 730, 727
See application file for complete search history.

(56) References Cited

U.S. PATENT DOCUMENTS

| | | | | |
|---|---|---|---|---|
| 2005/0153756 | A1* | 7/2005 | Sato | H01Q 1/243 455/575.7 |
| 2010/0103064 | A1* | 4/2010 | Yang | H01Q 1/243 343/793 |
| 2012/0013522 | A1 | 1/2012 | Yamaguchi et al. | |
| 2013/0002497 | A1* | 1/2013 | Hamabe | H01Q 1/38 343/730 |

FOREIGN PATENT DOCUMENTS

| | | | |
|---|---|---|---|
| JP | 2004-201278 | A | 7/2004 |
| JP | 2011-239287 | A | 11/2011 |
| JP | 2012-178741 | A | 9/2012 |
| WO | WO 2007/043150 | A1 | 4/2007 |
| WO | WO 2014/059382 | A1 | 4/2014 |

OTHER PUBLICATIONS

Chi et al., "Compact Printed Hepta-Band Monopole Antenna for Mobile Devices", Proceedings of Asai-Pacific Microwave Conference 2010 (FR3G-22), 2010, pp. 2216-2219.

Extended European Search Report of European Patent Application No. 15172399.6 dated Dec. 18, 2015.

* cited by examiner

BANDWIDTH IS 1.95 TO 2.08 GHz IN CASE OF PRESENCE OF PARASITIC ELEMENT 120

BANDWIDTH IS 1.95 TO 2.2 GHz IN CASE OF ABSENCE OF PARASITIC ELEMENT 120

——— PRESENCE OF PARASITIC ELEMENT 120

····· ABSENCE OF PARASITIC ELEMENT 120

ANTENNA DEVICE

CROSS-REFERENCE TO RELATED APPLICATION

This application is based upon and claims the benefit of priority of the prior Japanese Patent Application No. 2014-144999, filed on Jul. 15, 2014, the entire contents of which are incorporated herein by reference.

FIELD

The embodiments discussed herein are related to an antenna device.

BACKGROUND

Conventionally, there is known an antenna for a communication terminal device which includes a feed element whose end is unbalanced fed and a parasitic element that is provided substantially parallel to the feed element at an interval equal to or smaller than substantially 1/10 of the wavelength of a frequency used for transmission and reception and that has a length such that the parasitic element resonates in response to excitation of the feed element (see, for example, Japanese Laid-open Patent Publication No. 2003-198410).

In conventional antennas for a communication terminal device, the feed element runs from a feeding point so as to be separated from a ground plane and intersects the parasitic element at a stretched portion. This may undesirably hinder sufficient flow of an electric current into the parasitic element, thereby making it impossible for the parasitic element to obtain good radiation characteristics.

Accordingly, it is desired to provide an antenna device having good characteristics.

SUMMARY

According to an aspect of the invention, an antenna device includes a ground element; a first monopole antenna element including a first section that is connected to a first feeding point provided on the ground element side and that runs along the ground element, a second section that runs from an end of the first section in a direction away from the ground element, and a third section that runs along the ground element from an end of the second section, the first monopole antenna element having a first length that corresponds to ¼ of a wavelength at a first resonance frequency; a parasitic element including a first section whose end is connected to the ground element in the vicinity of the end of the first section of the first monopole antenna element and that runs in a direction away from the ground element and a second section that runs along the third section of the first monopole antenna element from an end of the first section of the parasitic element, the parasitic element having a second length that corresponds to ¼ of a wavelength at a second resonance frequency; and a dipole antenna element provided along the third section of the first monopole antenna element and the parasitic element, the dipole antenna element having a third length that corresponds to ½ of a wavelength at a third resonance frequency.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Embodiments of an antenna device according to the present disclosure are described below.

Embodiment 1

Figure 1:
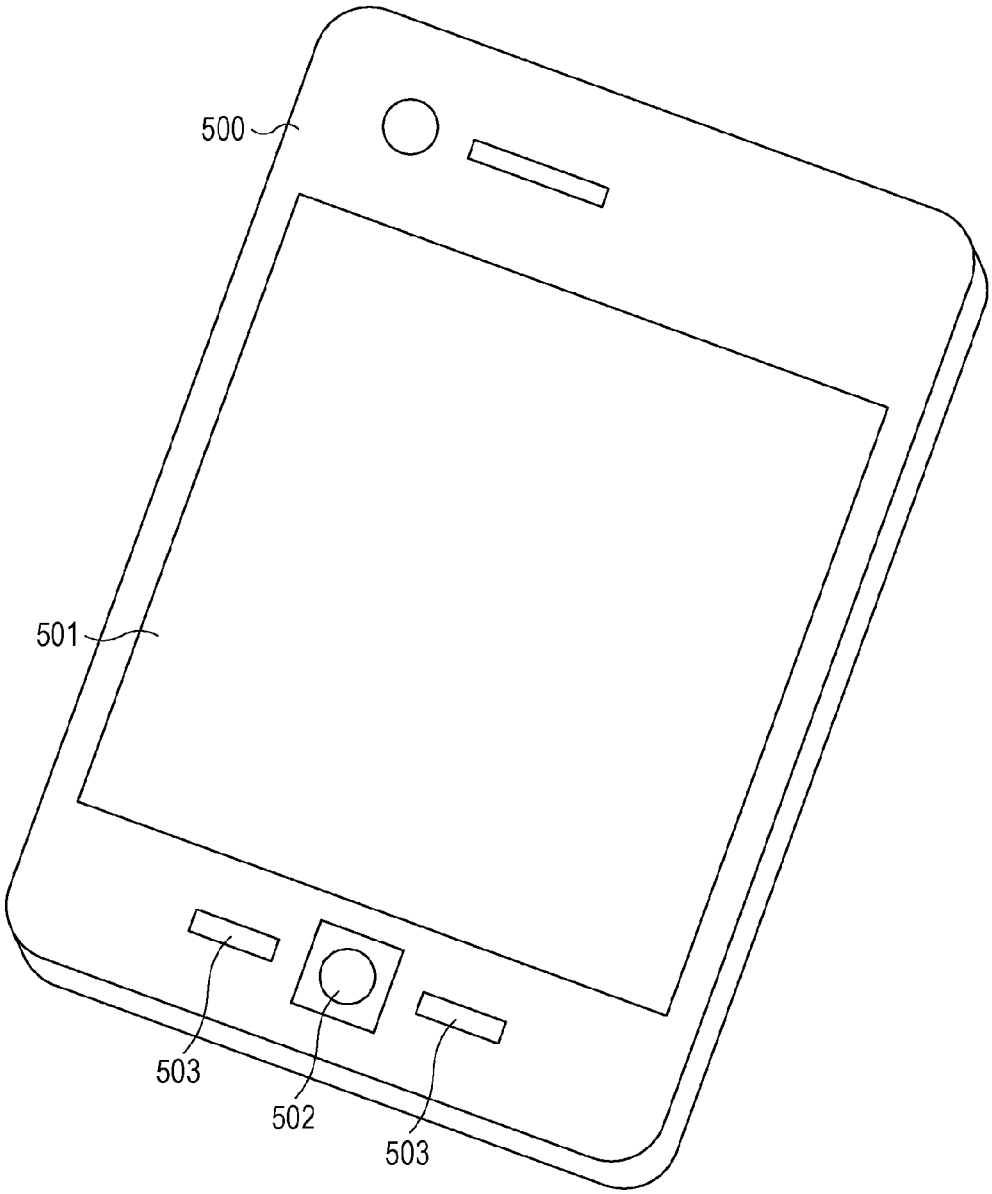
FIG. 1 is a perspective view illustrating a front side of a tablet computer including an antenna device according to Embodiment 1.

FIG. 1 is a perspective view illustrating a front side of a tablet computer 500 including an antenna device according to Embodiment 1.

The tablet computer 500 including the antenna device according to Embodiment 1 includes a touch panel 501 provided on the front side, and a home button 502 and a switch 503 that are provided on the bottom side of the touch panel 501.

Figure 2:
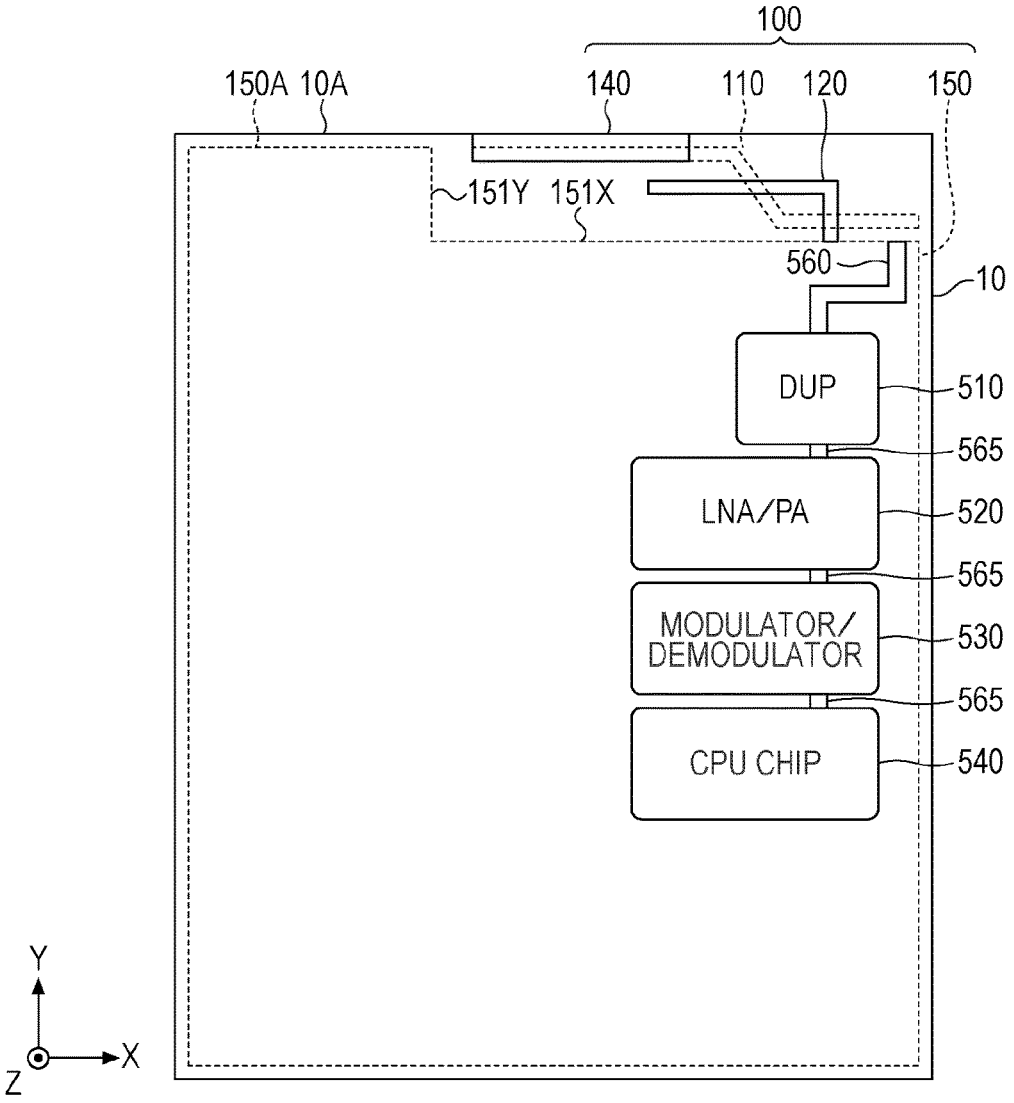
FIG. 2 is a plan view illustrating an antenna device according to Embodiment 1 and constituent elements related to the antenna device.

FIG. 2 is a plan view illustrating the antenna device 100 according to Embodiment 1 and constituent elements related to the antenna device 100. In FIG. 2, an XYZ coordinate system, which is an orthogonal coordinate system, is defined. Hereinafter, the term "plan view" refers to an XY plan view. Furthermore, for convenience of description, a surface on the positive Z-axis direction side is referred to as a front surface, and a surface on the negative Z-axis direction side is referred to as a rear surface. The "front surface" and "rear surface" used herein do not represent a universal front and rear relationship.

FIG. 2 illustrates constituent elements inside the tablet computer 500. An antenna device 100 is one of these constituent elements.

A chassis 10 is one of a plurality of chassis that constitute a chassis of the tablet computer 500 and is not visible from the outside of the tablet computer 500. The chassis 10 is made of a resin and has a size substantially equal to the tablet computer 500 in plan view. The actual shape of the chassis 10 is complex, but for convenience of description, it is assumed here that the chassis 10 is a rectangular plate-like member.

The antenna device 100 includes an antenna element 110, a parasitic element 120, a dipole antenna element 140, and a ground element 150. Among these members, the antenna element 110, the parasitic element 120, and the dipole antenna element 140 are formed on the chassis 10.

The antenna device 100 is provided in a portion cut out along edges 151X and 151Y from the ground element 150 in plan view.

The antenna element 110 is formed on a rear surface of the chassis 10. The parasitic element 120 is formed on a front surface of the chassis 10. The dipole antenna element 140 is formed on the front surface and a side surface of the chassis 10. The ground element 150 is provided on the rear surface side of the chassis 10.

The antenna element 110, the parasitic element 120, and the dipole antenna element 140 are formed, for example, by patterning a copper foil on the front surface, the side surface, and the rear surface of the chassis 10. Note that the antenna element 110, the parasitic element 120, and the dipole antenna element 140 may be made of a metal layer other than a copper foil.

The ground element 150 is a metal frame provided on a side opposite to a liquid crystal display (LCD) surface of the tablet computer 500. The actual shape of this frame is complex because the frame holds the LCD and is fixed on the chassis 10. However, for convenience of description, it is assumed here that the frame is a rectangular plate-like member that includes a projection 150A.

The projection 150A protrudes to reinforce an upper left corner of the tablet computer 500 in FIG. 2. The frame is made, for example, of magnesium. The projection 150A is a portion that remains after cutout of an upper right corner of the frame along the edges 151X and 151Y.

The edges 151X and 151Y run along the X-axis and the Y-axis, respectively. The edges 151X and 151Y define the portion that has been cut out from the frame and in which the antenna device 100 is provided. Note that the upper right portion of the tablet computer 500 in FIG. 2 is reinforced by a member other than the frame.

A duplexer (DUP) 510, a low noise amplifier (LNA)/power amplifier (PA) 520, a modulator/demodulator 530, and a central processing unit (CPU) chip 540 are mounted inside the chassis 10. Note that a matching circuit (not illustrated in FIG. 2) that adjusts impedance characteristics is provided between the antenna device 100 and the DUP 510. The matching circuit is described later with reference to FIG. 14.

The DUP 510, the LNA/PA 520, the modulator/demodulator 530, and the CPU chip 540 are provided, for example, between the LCD and the frame constituting the ground element 150.

The DUP 510, the LNA/PA 520, the modulator/demodulator 530, and the CPU chip 540 are connected via a wire 565.

The DUP 510 is connected to the antenna element 110 of the antenna device 100 via a wire 560 and switches transmission and reception. Since the DUP 510 functions as a filter, the DUP 510 may separate signals having respective frequencies when the antenna device 100 receives these signals.

The LNA/PA 520 amplifies electric power of a transmission wave and a reception wave. The modulator/demodulator 530 modulates the transmission wave and demodulates the reception wave. The CPU chip 540 functions as a communication processor that performs communication processing of the tablet computer 500 and as an application processor that executes an application program. The CPU chip 540 includes an internal memory in which transmitted data, received date, or the like is stored.

Note that the wires 560 and 565 are formed, for example, together with the parasitic element 120 by pattering a copper foil on the front surface of the chassis 10.

Next, a detailed configuration of the antenna device 100 is described with reference to FIG. 3. In the following description, only the antenna element 110, the parasitic element 120, the dipole antenna element 140, and the ground element 150 that are included in the antenna device 100 are described.

Figure 3:
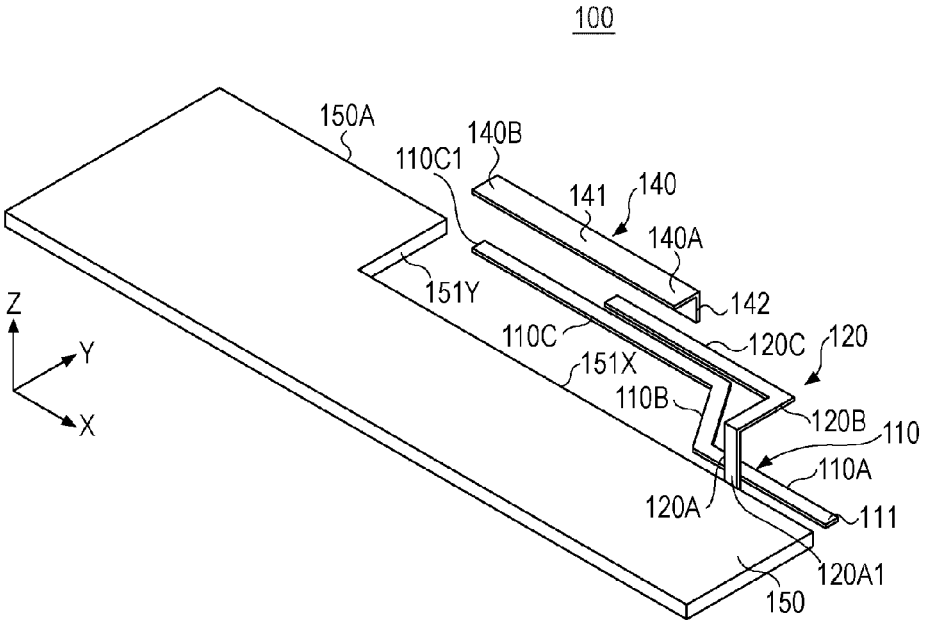
FIG. 3 is a diagram illustrating the antenna device according to Embodiment 1.

FIG. 3 is a diagram illustrating the antenna device 100 according to Embodiment 1. In FIG. 3, an XYZ coordinate system identical to that of FIG. 2 is defined.

The antenna element 110, the parasitic element 120, the dipole antenna element 140 are designed, for example, so as to fit into a space whose length in the X-axis direction is 60 mm, whose width in the Y-axis direction is 8 mm, and whose height in the Z-axis direction is 3 mm.

The antenna element 110 is a monopole antenna including element portions 110A, 1106, and 110C, and a feeding point 111. The element portions 110A, 110B, and 110C are connected in this order, and the feeding point 111 is formed at an end of the element portion 110A in the positive X-axis direction. The wire 560 illustrated in FIG. 1 is connected to the feeding point 111 via a via hole or the like that passes through the chassis 10.

The antenna element 110 is an example of a first monopole antenna element. The element portions 110A, 110B, and 110C are examples of a first section, a second section, and a third section, respectively.

The length of the antenna element 110 is set, for example, so as to correspond to ¼ of an effective wavelength λ1 of 700 MHz to 960 MHz. The length of the antenna element 110 is the total length of the element portions 110A, 1106, and 110C and is an example of a first length.

The element portion 110A runs in the negative X-axis direction from the feeding point 111 along the edge 151X of the ground element 150. The element portion 110A and the edge 151X are parallel to each other. Note that the element portion 110A has only to runs along the edge 151X, and the element portion 110A does not have to be perfectly parallel to the edge 151X.

The interval between the element portion 110A and the edge 151X is set so that sufficient coupling between the element portion 110A and the ground element 150 is obtained. This arrangement in which the element portion 110A is close to the ground element 150 is employed in order to increase the amount of electric current flowing into a portion of the ground element 150 that is close to the element portion 110A.

Note that although it is assumed that the positions of the element portion 110A and the ground element 150 in the Z-axis direction are the same, these positions in the Z-axis direction may be different from each other as long as coupling may be achieved without any problem.

The element portion 110B runs from an end of the element portion 110A on the negative X-axis direction side in a direction oblique with respect to the negative X-axis direction and the positive Y-axis direction in plan view. That is, the element portion 110B runs in a direction away from the ground element 150. Note that the length of the element portion 110B is substantially equal to that of the element portion 110A.

The element portion 110C runs parallel to the X-axis from an end of the element portion 110B on the negative X-axis direction side. The length of the element portion 110C is, for example, two to three times longer than those of the element portions 110A and 110B. The element portion 110C is separated from the ground element 150 by a distance longer than that of the element portion 110A.

By thus separating the element portion 110C from the ground element 150, it is possible to improve the radiation characteristics of the antenna element 110 and to obtain a desired level of resonance for communication.

The parasitic element 120 includes element portions 120A, 120B, and 120C. The element portions 120A, 120B, and 120C are connected in this order, and an end 120A1 of the element portion 120A on the negative Z-axis direction is connected to the edge 151X of the ground element 150.

The length of the parasitic element 120 is set, for example, so as to correspond to ¼ of an effective wavelength λ2 of 1.5 GHz. The length of the parasitic element 120 is equal to the total length of the element portions 120A, 120B, and 120C and is an example of a second length. The element portions 120A and 120B are examples of a first section, and the element portion 120C is an example of a second section.

The element portion 120A runs from the end 120A1 on the negative Z-axis direction side toward the positive Z-axis direction side. The end 120A1 is connected to the ground element 150 between the end of the element portion 110A on the positive X-axis direction side and the end of the element portion 110A on the negative X-axis direction side. The end 120A1 is located close to the element portion 110A.

This arrangement in which the element portion 120A is located close to the element portion 110A is employed in order to allow an electric current to flow from a portion of the ground element 150 that is close to the element portion 110A to the element portion 120A.

The element portion 120B runs in the positive Y-axis direction from an end of the element portion 120A on the positive Z-axis direction side. This arrangement in which the element portion 120B runs in the positive Y-axis direction is employed in order to improve the radiation characteristics of the parasitic element 120 by separating the element portion 120C from the ground element 150. Note that the length of the element portion 120B is substantially equal to that of the element portion 120A.

The element portion 120C runs in the negative X-axis direction from an end of the element portion 120B on the positive Y-axis direction side. That is, the element portion 120C is parallel to the element portion 110A and the edge 151X. The length of the element portion 120C is several times longer than those of the element portions 120A and 1206.

The arrangement in which the element portion 120C is parallel to the element portion 110A and the edge 151X is employed in order to achieve electromagnetic field coupling and resonance with the element portions 120A and 120B. This also suppresses deterioration of the efficiency of the parasitic element 120.

Note that the parasitic element 120 is also used to adjust the impedance characteristics of the dipole antenna element 140. Resonance of the dipole antenna element 140 may be sharpened by optimizing the position and the shape of the parasitic element 120.

The dipole antenna element 140 is disposed along an edge 10A (see FIG. 2) that runs in the X-axis direction on the positive Y-axis direction side of the chassis 10 and includes an element portion 141 parallel to the XY plane and an element portion 142 parallel to the XZ plane. Furthermore, the dipole antenna element 140 includes an end 140A on the negative X-axis direction side and an end 140B on the positive X-axis direction side.

The length of the dipole antenna element 140 between the end 140A and the end 140B is set, for example, so as to correspond to ½ of an effective wavelength λ4 of 2.5 GHz to 2.7 GHz. The length between the end 140A and the end 140B is an example of a third length.

The dipole antenna element 140 includes a section that overlaps the element portions 110C and 120C in the X-axis direction. This arrangement is employed in order to supply an electric current from at least one of the antenna element 110 and the parasitic element 120 by coupling the dipole antenna element 140 to the antenna element 110 and/or the parasitic element 120.

The position of the end 140B of the dipole antenna element 140 and the position of an end 110C1 of the antenna element 110 on the negative X-axis direction side are the same with respect to the X-axis direction. This arrangement is employed in order to efficiently transmit an electric field generated by the antenna element 110 to the dipole antenna element 140 by causing the position of the end 110C1, at which the electric field is largest in the antenna element 110, and the position of the end 140B of the dipole antenna element 140 to be the same with respect to the X-axis direction.

The element portion 141 is formed on a front surface of the chassis 10 (see FIG. 2) parallel to the XY plane, and the element portion 142 is formed on a side surface of the chassis 10 that is parallel to the XZ plane. The dipole antenna element 140 has a shape such that a plate-like copper foil is bent along the edge 10A.

This arrangement is employed in order to secure a wide width of the dipole antenna element 140 and achieve a wider bandwidth. With this arrangement, it is possible to obtain resonance in a bandwidth of 2.5 GHz to 2.7 GHz. Furthermore, with the arrangement in which the element portion 142 is bent with respect to the element portion 141, it is possible to suppress an increase in the dimensions of the antenna device 200 in the Y-axis direction.

Note that the width in the Y-axis direction of the element portion 141 of the dipole antenna element 140 is unchanged in the X-axis direction, and the width in the Z-axis direction of the element portion 142 of the dipole antenna element 140 is unchanged in the X-axis direction. However, it is also possible to employ an arrangement in which the width of the element portion 141 in the Y-axis direction and the width of the element portion 142 in the Z-axis direction are minimum at the center in the X-axis direction and maximum at the end 140A and the end 140B.

This means that the dipole antenna element 140 has a bow-tie-like shape bent along the XY plane and the XZ plane. Since a dipole antenna has a maximum electric field at both ends and a minimum electric field at the center, the arrangement in which the width increases from the center toward both ends allows the dipole antenna element 140 to have a shape effective for a wider bandwidth.

The ground element 150 includes the edge 151X that is parallel to the X-axis and the edge 151Y that is parallel to the Y-axis. The ground element 150 has a shape such that a region defined by the edges 151X and 151Y is cut out. The antenna element 110, the parasitic element 120, and the dipole antenna element 140 are formed in a region that does not overlap the ground element 150 in plan view.

Next, the radiation characteristics of the antenna device 100 according to Embodiment 1 are described with reference to FIG. 4.

Figure 4:
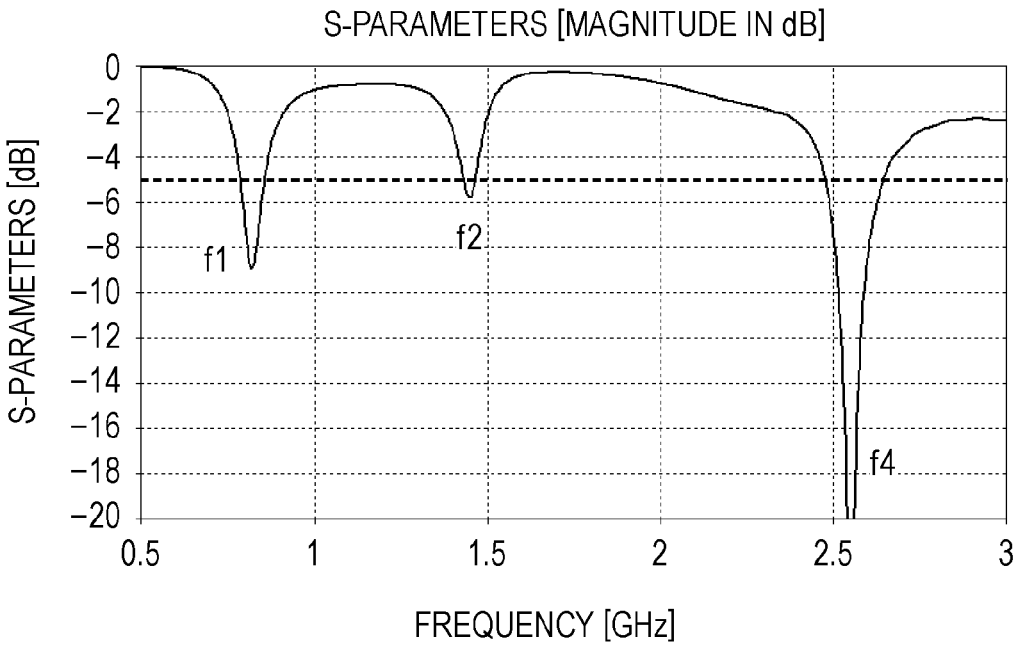
FIG. 4 is a diagram illustrating the radiation characteristics of the antenna device according to Embodiment 1.

FIG. 4 illustrates the radiation characteristics of the antenna device 100 according to Embodiment 1. The following discusses frequency characteristics of the S11 parameter as an example of the radiation characteristics. The frequency characteristics of the S11 parameter were obtained by electromagnetic field simulation using a model of the antenna device 100.

The following describes an example in which evaluation is conducted assuming that an evaluation standard of the value of the S11 parameter is −5 dB and a bandwidth of not more than −5 dB is a communicable range of the antenna device 100.

As illustrated in FIG. 4, a value of not more than −5 dB was obtained in three bandwidths, i.e., approximately 750 MHz to 800 MHz (f1), approximately 1.4 GHz to 1.45 GHz (f2), and approximately 2.45 GHz to 2.7 GHz (f4). It was thus confirmed that communication may be performed at resonance frequencies f1, f2, and f4 in these bandwidths.

The resonance frequencies f1, f2, and f4 are examples of a first resonance frequency, a second resonance frequency, and a third resonance frequency, respectively.

The following describes the radiation characteristics of an antenna device 300 according to a comparative example obtained by modifying the shape of the antenna element 110.

Figure 5:
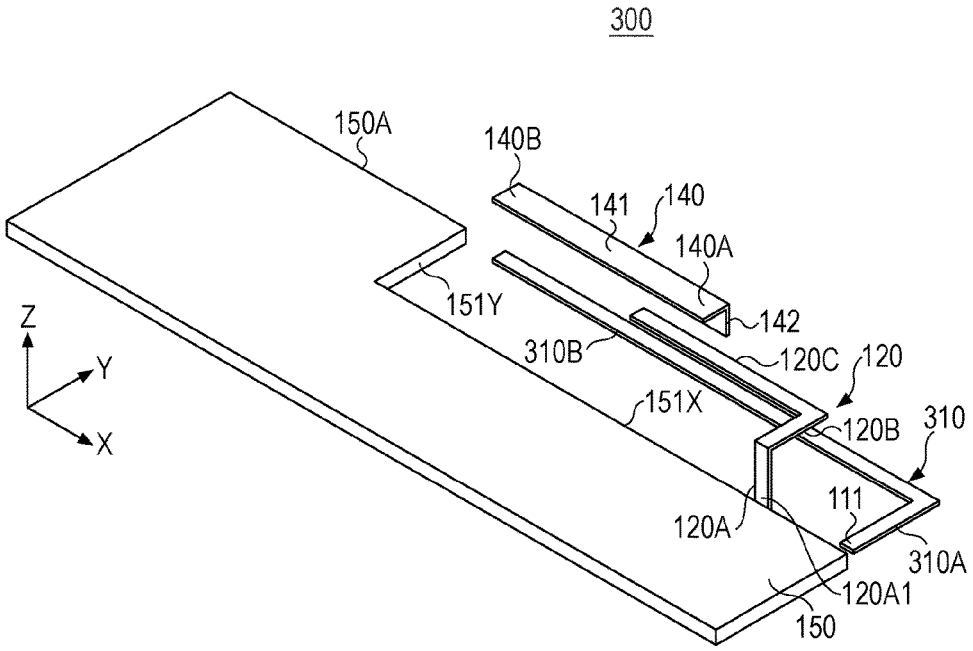
FIG. 5 is a diagram illustrating an antenna device according to a comparative example.

FIG. 5 is a diagram illustrating the antenna device 300 according to the comparative example. The antenna device 300 includes an antenna element 310, a parasitic element 120, and a dipole antenna element 140. The parasitic element 120 and the dipole antenna element 140 are similar to those in the antenna device 100 illustrated in FIG. 3.

The antenna element 310 includes element portions 310A and 310B and a feeding point 111. The feeding point 111 is located at the same position as the feeding point 111 of the antenna device 100 illustrated in FIG. 3. The element portion 310A runs in the positive Y-axis direction from the feeding point 111. The element portion 310B runs in the negative X-axis direction from an end of the element portion 310A. The length of the antenna element 310 is equal to that of the antenna element 110 illustrated in FIG. 3.

Since the element portion 310A runs from the feeding point 111 in a direction away from the ground element 150, the amount of electric current that flows from the antenna element 310 to the ground element 150 is smaller than that in the antenna device 100 illustrated in FIG. 3.

Figure 6:
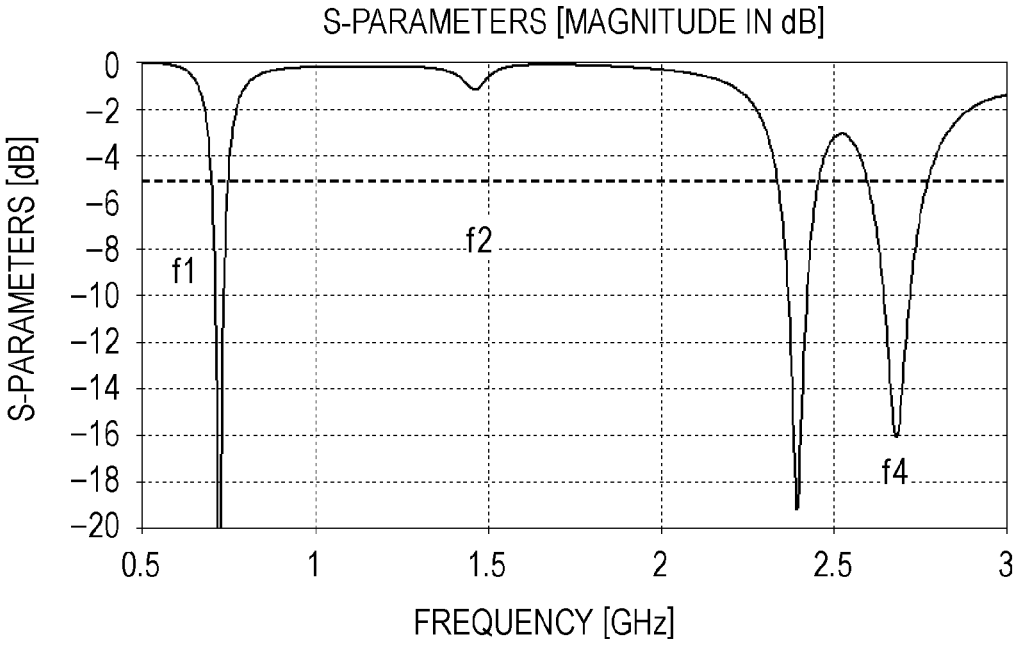
FIG. 6 is a diagram illustrating the radiation characteristics of the antenna device according to the comparative example.

FIG. 6 is a diagram illustrating the radiation characteristics of the antenna device 300 according to the comparative example. As in FIG. 4, the frequency characteristics of the S11 parameter are illustrated in FIG. 6. The frequency characteristics of the S11 parameter illustrated in FIG. 6 were obtained by electromagnetic field simulation using a model of the antenna device 300.

As illustrated in FIG. 6, a value of not more than −5 dB was obtained in bandwidths of around 750 MHz (f1), approximately 2.4 GHz, and approximately 2.7 GHz (f4). However, the value of the S11 parameter in the bandwidth of the resonance frequency f2 was approximately −1 dB to approximately 0 dB. It was thus revealed that radiation of the parasitic element 120 was not obtained in the bandwidth of the resonance frequency f2.

The above results confirmed that an electric current flows from the antenna element 110 to the ground element 150 due to proximity of the element portion 110A of the antenna element 110 to the ground element 150 and that resonance occurs due to flow of the electric current from the ground element 150 to the parasitic element 120.

As described above, according to Embodiment 1, the antenna device 100 including the above configuration makes it possible to perform communication at the three resonance frequencies f1, f2, and f4.

Therefore, according to Embodiment 1, it is possible to provide an antenna device 100 whose radiation characteristics at the three resonance frequencies f1, f2, and f4 are good.

Currently, the frequencies of 700 MHz to 960 MHz (f1), 1.5 GHz (f2), and 1.7 to 2.1 GHz (f3) are allocated in Japan, and the frequencies of 700 MHz to 960 MHz (f1), 1.7 to 2.1 GHz (f3), and 2.5 GHz to 2.7 GHz (f4) are allocated in the United States and Europe.

Since the resonance frequency f2 is approximately two-fold higher than the resonance frequency f1 and the resonance frequency f4 is approximately four-fold higher than the resonance frequency f1, bandwidths of the resonance frequencies f2 and f4 do not overlap with bandwidths of the third harmonic and the fifth harmonic of the resonance frequency f1.

Therefore, in consideration of an antenna device that may be used in the three geographical regions, i.e., Japan, the United States, and Europe, a configuration including an element (the parasitic element 120) corresponding to the resonance frequency f2 and an element (the dipole antenna element 140) corresponding to the resonance frequency f4 like the antenna device 100 according to Embodiment 1 is desired.

Since the resonance frequencies f2 and f4 are higher than the resonance frequency f1, the elements corresponding to the resonance frequencies f2 and f4 are small. Since the resonance frequency f4 is highest, the element corresponding to the resonance frequency f4 may be made smallest. Therefore, even when a dipole antenna is used and as a result the length of the element doubles, no space-related problems occur.

Therefore, the antenna device 100 including the parasitic element 120 that corresponds to the resonance frequency f2 and the dipole antenna element 140 that corresponds to the resonance frequency f4 is very useful.

Note that the antenna device 100 according to Embodiment 1 does not support the bandwidth of 1.7 to 2.1 GHz (f3) and is therefore useful in a case where the bandwidth of 1.7 to 2.1 GHz (f3) is not used. An antenna device that supports the bandwidth of 1.7 to 2.1 GHz (f3) is described in Embodiment 2.

Although the arrangement in which the element portions 110C and 120C, and the dipole antenna element 140 are disposed parallel to each other has been described above, the element portions 110C and 120C, and the dipole antenna element 140 do not necessarily have to be parallel to each other.

Although the arrangement in which the ascending order of frequency is the resonance frequency f1, the resonance frequency f2, and the resonance frequency f4 has been described above, the order of the resonance frequency f2 and the resonance frequency f4 may be shuffled. That is, in a case where the length of the parasitic element 120 and the length of the dipole antenna element 140 may be adjusted during the design stage, the order of the resonance frequency f2 and the resonance frequency f4 may be shuffled by changing these lengths.

Although the arrangement in which the antenna device 100 is applied to the tablet computer 500 has been described above, a target application of the antenna device 100 is not limited to the tablet computer 500 and may be a terminal device, such as a smartphone terminal device or a mobile phone terminal device, that performs communication.

Embodiment 2

Figure 7:
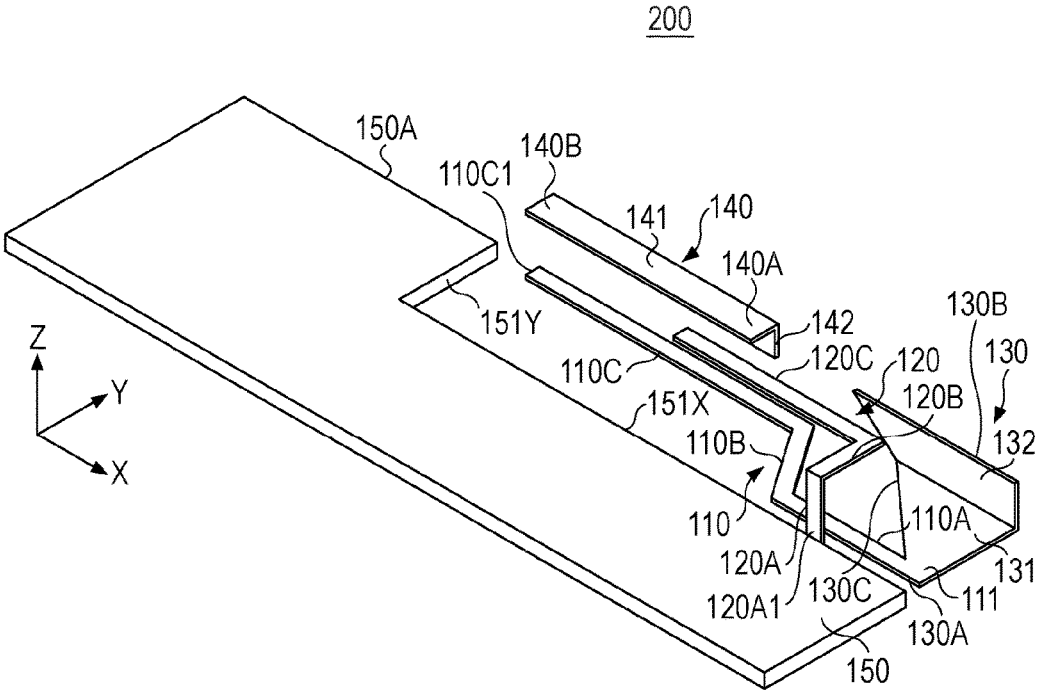
FIG. 7 is a diagram illustrating an antenna device according to Embodiment 2.
Figure 8:
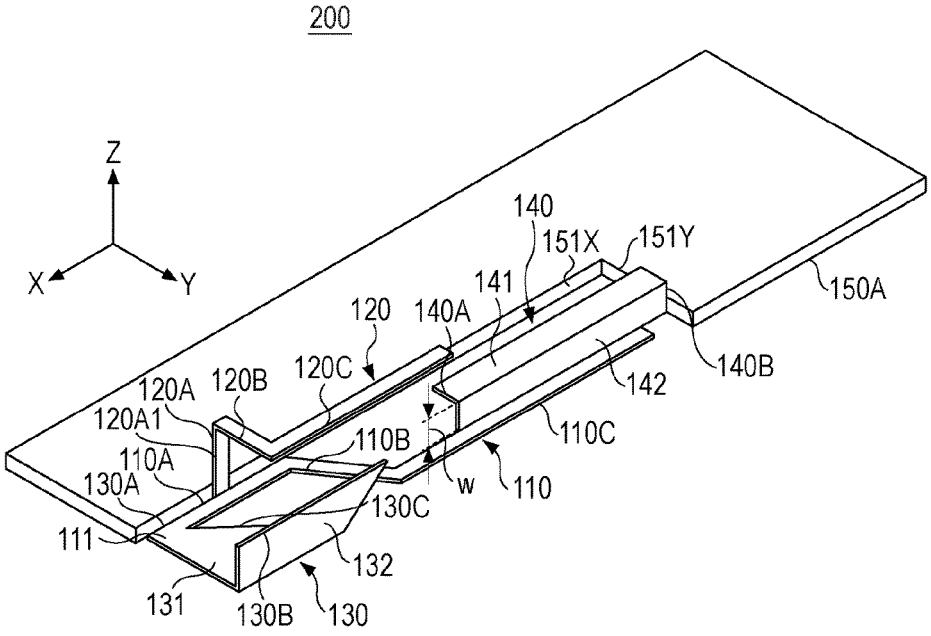
FIG. 8 is a diagram illustrating the antenna device according to Embodiment 2.

FIGS. 7 and 8 are diagrams illustrating an antenna device 200 according to Embodiment 2. In FIGS. 7 and 8, an XYZ coordinate system identical to that in FIGS. 2 and 3 is defined. FIG. 7 illustrates the antenna device 200 viewed in a direction from the negative Y-axis direction side to the positive Y-axis direction side as in FIG. 3, and FIG. 8 illustrates the antenna device 200 viewed in a direction from the positive Y-axis direction side to the negative Y-axis direction side.

The antenna device 200 includes an antenna element 110, a parasitic element 120, an antenna element 130, a dipole antenna element 140, and a ground element 150. The antenna device 200 includes a configuration obtained by adding the antenna element 130 to the antenna device 100 according to Embodiment 1 (see FIG. 3). The other constituent elements are similar to those of the antenna device 100 according to Embodiment 1, and therefore the similar constituent elements are given identical reference signs and are not explained repeatedly.

The antenna element 110, the parasitic element 120, the antenna element 130, and the dipole antenna element 140 are, for example, designed so as to fit into a space whose length in the X-axis direction is 60 mm, whose width in the Y-axis direction is 8 mm, and whose height in the Z-axis direction is 3 mm.

The antenna element 130 is formed integrally with the antenna element 110 and is branched from the antenna element 110 at a feeding point 111. The antenna element 130 includes an element 131 formed on a rear surface of a chassis 10 (see FIG. 2) and an element 132 formed on a side surface of the chassis 10. The antenna element 130 is an example of a second monopole antenna element.

The antenna element 130 is separated from the antenna element 110 by running in the positive Y-axis direction from the feeding point 111. This arrangement is employed in order to reduce coupling between the antenna elements 130 and 110 and thereby suppress each other's influences.

The elements 131 and 132 have a trapezoidal shape whose length becomes longer from a lower base (an edge 130A) on the feeding point 111 side toward an upper base (an edge 130B) in plan view in a state in which the elements 131 and 132 are flattened without being bent.

This arrangement is employed in order to secure a wide width of the antenna element 130 and thereby achieve a wider bandwidth. With this arrangement, it is possible to obtain resonance in a bandwidth of 1.7 GHz to 2.1 GHz (f3). The resonance frequency f3 is an example of a fourth resonance frequency.

The arrangement in which the edge 130B on the tip side is longer than the edge 130A on the feeding point 111 side is employed because the antenna element 130 functions as a monopole antenna and making the edge 130B on the tip side, at which the electric field is maximum, longer is more effective for a wider bandwidth.

Note that the length of an edge 130C, which is an oblique side of the antenna element 130, is set so as to correspond to ¼ of an effective wavelength λ3 of 1.7 GHz to 2.1 GHz. The length of the edge 130C is an example of a fourth length.

In the antenna device 200 according to Embodiment 2, the parasitic element 120 is also used to adjust the impedance characteristics of the antenna element 130, and the bandwidth of the antenna element 130 may be widened by optimizing the position and shape of the parasitic element 120.

Especially in the antenna device 200 according to Embodiment 2, the position and shape of the parasitic element 120 are determined so that the bandwidth of the resonance frequency f3 of the antenna element 130 is combined (united) with the bandwidth of the third harmonic of the resonance frequency of the antenna element 110 to form a wider bandwidth. In other words, the parasitic element 120 is designed so that the resonance frequency f3 forms an integral bandwidth with the bandwidth of the third harmonic of the resonance frequency of the antenna element 110.

Figure 9:
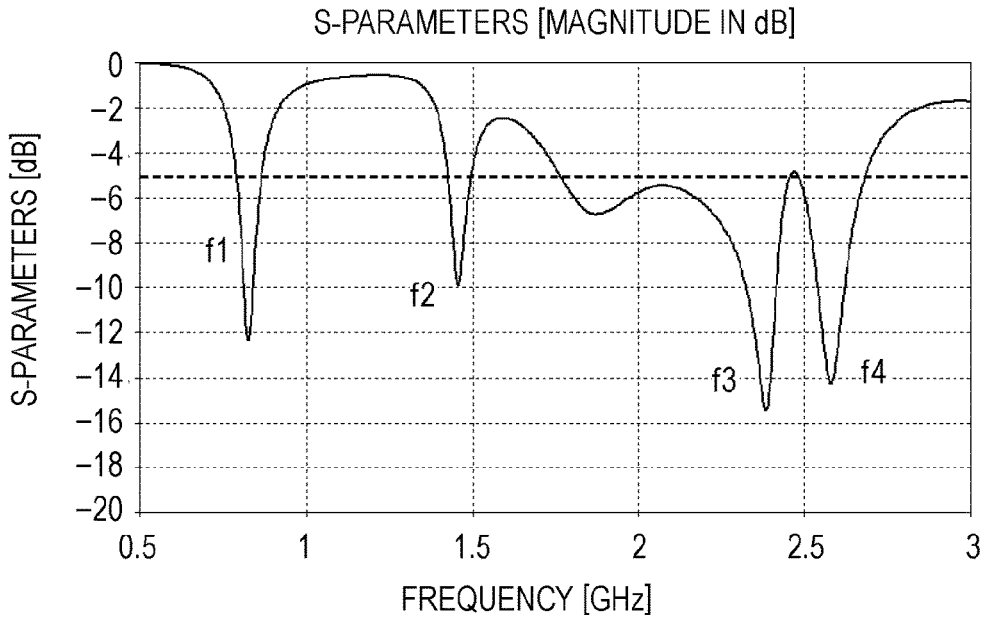
FIG. 9 is a diagram illustrating the radiation characteristics of the antenna device according to Embodiment 2.

FIG. 9 is a diagram illustrating the radiation characteristics of the antenna device 200 according to Embodiment 2. The following discusses the frequency characteristics of the S11 parameter as an example of the radiation characteristics. The frequency characteristics of the S11 parameter were obtained by electromagnetic field simulation using a model of the antenna device 200.

The following describes an example in which evaluation is conducted assuming that an evaluation standard of the value of the S11 parameter is −5 dB and a bandwidth of not more than −5 dB is a communicable range of the antenna device 200.

As illustrated in FIG. 9, a value of not more than −5 dB was obtained in four bandwidths, i.e., approximately 770 MHz to 800 MHz (f1), approximately 1.4 GHz to 1.5 GHz (f2), and approximately 1.75 GHz to 2.7 GHz (f3 and f4). It was thus confirmed that communication may be performed at resonance frequencies f1, f2, f3, and f4 in these bandwidths.

This indicates that the bandwidth of the resonance frequencies f2 and f4 are wider as a result of addition of the antenna element 130 as compared with the radiation characteristics (see FIG. 3) of the antenna device 100 according to Embodiment 1. This is considered to be because addition of the antenna element 130 has changed the impedance characteristics of the parasitic element 120 and the dipole antenna element 140 and increased the number of electric current supply routes.

Figure 10:
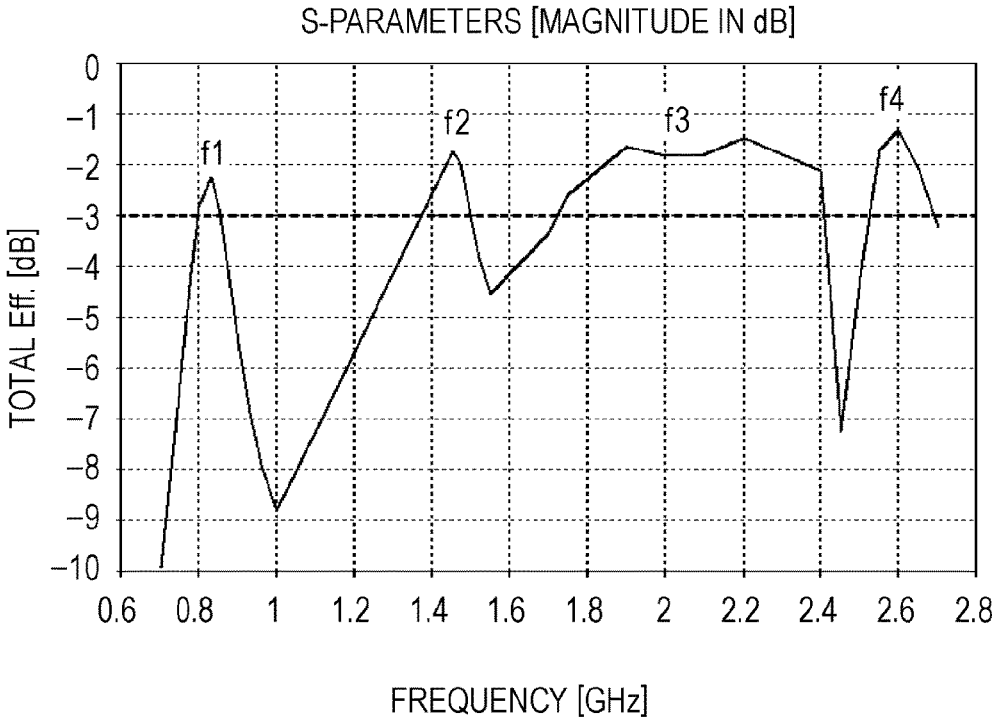
FIG. 10 is a characteristic diagram illustrating the efficiency of the antenna device according to Embodiment 2.

FIG. 10 is a characteristic diagram illustrating the efficiency of the antenna device 200 according to Embodiment 2. The efficiency illustrated in FIG. 10 was calculated by subtracting reflected electric power and loss from electric power that enters the antenna device 200. It is assumed here that −3 dB is a judgment standard and a bandwidth in which a value of not less than −3 dB was obtained is determined as a bandwidth in which reception is possible.

As illustrated in FIG. 10, the efficiency of the antenna device 200 was not less than −3 dB in four bandwidths, i.e., the resonance frequencies f1, f2, f3, and f4.

Since the bandwidths of the resonance frequencies f1, f2, f3, and f4 overlap with all of the communication bandwidths in the three geographical regions, i.e., Japan, the United States, and Europe, communication is possible in the three geographical regions, i.e., Japan, the United States, and Europe by using the antenna device 200 alone.

Figure 11:
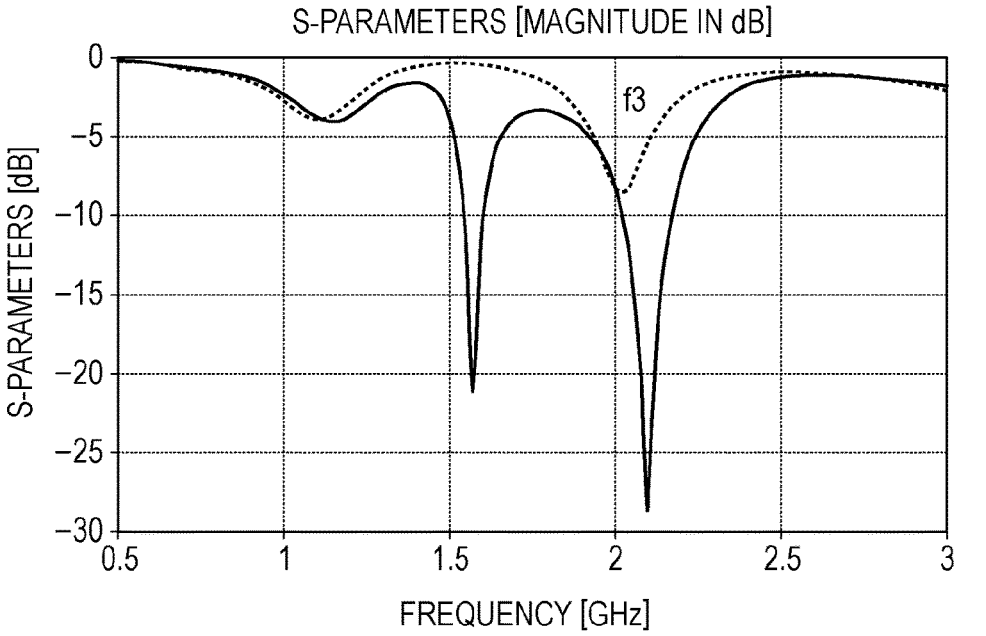
FIG. 11 is a diagram illustrating how the radiation characteristics (S11 parameter) of the antenna element vary depending on presence or absence of a parasitic element.
Figure 12:
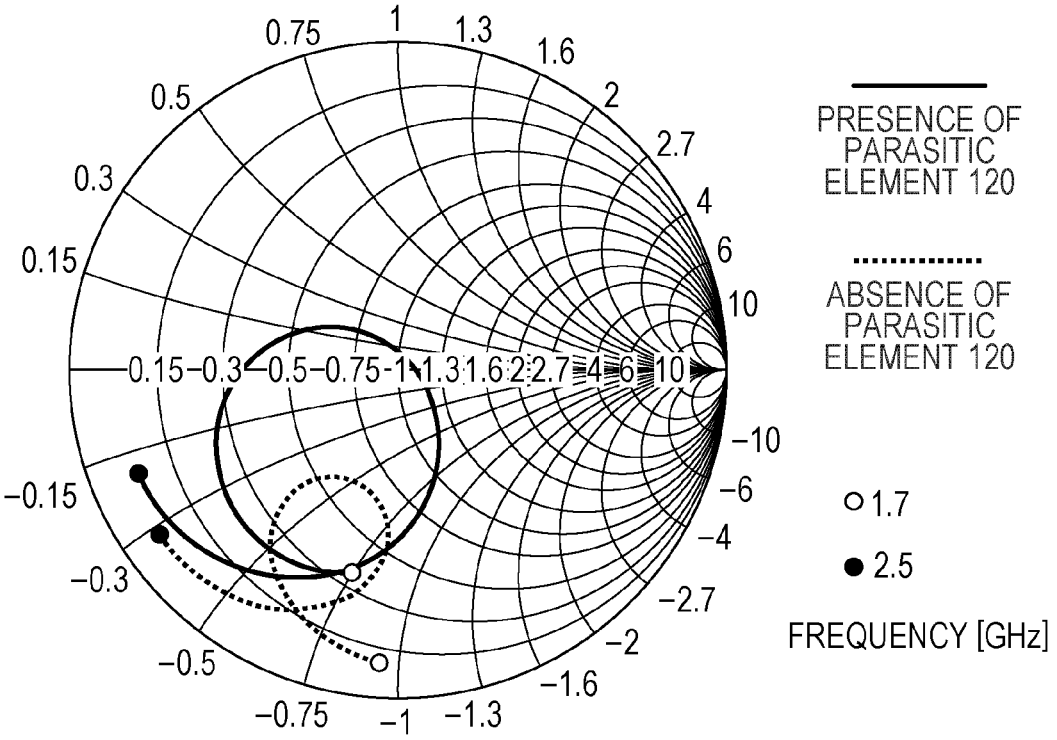
FIG. 12 is a diagram illustrating how the characteristics vary in the Smith chart of an antenna element depending on presence or absence of the parasitic element.

The following describes how the characteristics change depending on presence or absence of the parasitic element 120 with reference to FIGS. 11 and 12.

FIG. 11 is a diagram illustrating how the radiation characteristics (S11 parameter) of the antenna element 130 vary depending on presence or absence of the parasitic element 120. FIG. 12 is a diagram illustrating how the characteristics in the Smith chart of the antenna element 130 vary depending on presence or absence of the parasitic element 120.

In FIGS. 11 and 12, the characteristics of the antenna device 200 that includes the parasitic element 120 are indicated by the solid line, and the characteristics of an antenna device for comparison that does not include the parasitic element 120 are indicated by the broken line. The radiation characteristics and the Smith chart illustrated in FIGS. 11 and 12 were obtained by simulation conducted in a state where no matching circuit was used.

These characteristics were obtained by electromagnetic field simulation using a model of the antenna device 200 and a model of the antenna device that does not include the parasitic element 120.

As illustrated in FIG. 11, the antenna device that does not include the parasitic element 120 reflects more than the antenna device 200 that includes the parasitic element 120.

In the antenna element 130 of the antenna device 200 that includes the parasitic element 120, a value of not more than −5 dB was obtained as for the resonance frequency f3 in a wide bandwidth of approximately −1.95 GHz to approximately 2.2 GHz.

Meanwhile, in the antenna element 130 of the antenna device that does not include the parasitic element 120, a value of not more than −5 dB was obtained as for the resonance frequency f3 in a bandwidth of approximately −1.95 GHz to approximately 2.08 GHz.

That is, presence of the parasitic element 120 makes it possible to suppress reflection of the antenna element 130 in a wider bandwidth and thereby improve the impedance characteristics.

As illustrated in FIG. 12, the characteristics of the antenna element 130 of the antenna device that includes the parasitic element 120 are closer to the center and wider than those of the antenna element 130 of the antenna device that does not include the parasitic element 120. This indicates a wider bandwidth.

As is clear from FIGS. 11 and 12, the impedance characteristics of the antenna element 130 improve due to the parasitic element 120.

Figure 13:
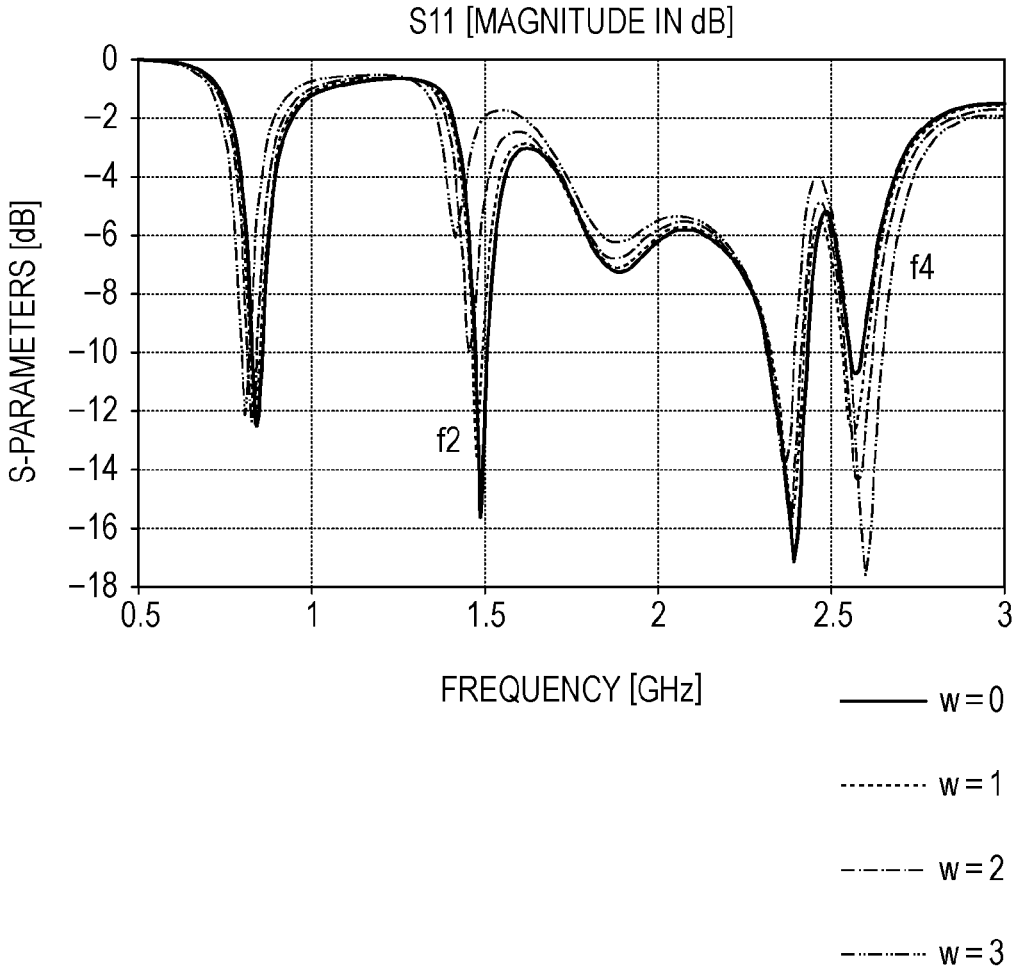
FIG. 13 is a diagram illustrating a relationship between the interval in a Y-axis direction between a dipole antenna element and the parasitic element and the radiation characteristics.

FIG. 13 is a diagram illustrating a relationship between the interval in the Y-axis direction between the dipole antenna element 140 and the parasitic element 120 and the radiation characteristics. This characteristics were obtained by changing the width w of the element portion 141 in the Y-axis direction in a model of the antenna device 200.

The characteristics were obtained in four cases of w=0 (mm), 1 (mm), 2 (mm), and 3 (mm). Note that the position of the parasitic element 120 is fixed, and a change of the value of the width w means a change of the width of the element portion 141 in the Y-axis direction and a change of the width of the dipole antenna element 140. In the case of w=0 (mm), the dipole antenna element 140 does not include the element portion 141 and includes only the element portion 142.

Comparison of the cases of w=0 (mm), 1 (mm), 2 (mm), and 3 (mm) reveals that the value of the S11 parameter of the bandwidth of the resonance frequency f2 increases and the characteristics deteriorate as the value of w increases from 0 (mm) to 3 (mm). It is revealed that the value of the S11 parameter in the case of w=3 (mm) may be considered as a minimum value that allows communication in four frequency bandwidths of the resonance frequencies f1, f2, f3, and f4, and a further increase of the width w makes communication at the four resonance frequencies f1, f2, f3, and f4 hard.

In the case of w=3 (mm), the interval in the Y-axis direction between the dipole antenna element 140 and the parasitic element 120 corresponds to 15/1000 (0.015λ4) of an effective wavelength λ4 obtained in a case where the resonance frequency f4 is set to 2.5 GHz.

Accordingly, the interval in the Y-axis direction between the dipole antenna element 140 and the parasitic element 120 has to be not less than 15/1000 (0.015λ4) of the effective wavelength λ4 at the resonance frequency f4.

As described above, according to Embodiment 2, the antenna device 200 including the above configuration makes it possible to perform communication at the four resonance frequencies f1, f2, f3, and f4.

Therefore, according to Embodiment 2, it is possible to provide an antenna device 200 whose radiation characteristics at the four resonance frequencies f1, f2, f3, and f4 are good.

The antenna device 200 according to Embodiment 2 includes the antenna element 130 that corresponds to the resonance frequency f3 in addition to the antenna element 110 that corresponds to the resonance frequency f1, the parasitic element 120 that corresponds to the resonance frequency f2, and the dipole antenna element 140 that corresponds to the resonance frequency f4.

That is, the antenna device 200 supports all of the bandwidths allocated in the three geographical regions, i.e., Japan, the United States, and Europe. Therefore, the antenna device 200 is very useful.

Although the arrangement in which the ascending order of frequency is the resonance frequency f1, the resonance frequency f2, the resonance frequency f3, and the resonance frequency f4 has been described above, the order of the resonance frequency f2, the resonance frequency f3, and the resonance frequency f4 may be shuffled. That is, in a case where the length of the parasitic element 120, the length of the antenna element 130, and the length of the dipole antenna element 140 may be adjusted during the design stage, the order of the resonance frequency f2, the resonance frequency f3, and the resonance frequency f4 may be shuffled by changing these lengths.

The following describes a modification of the antenna device 200 according to Embodiment 2.

Figure 14:
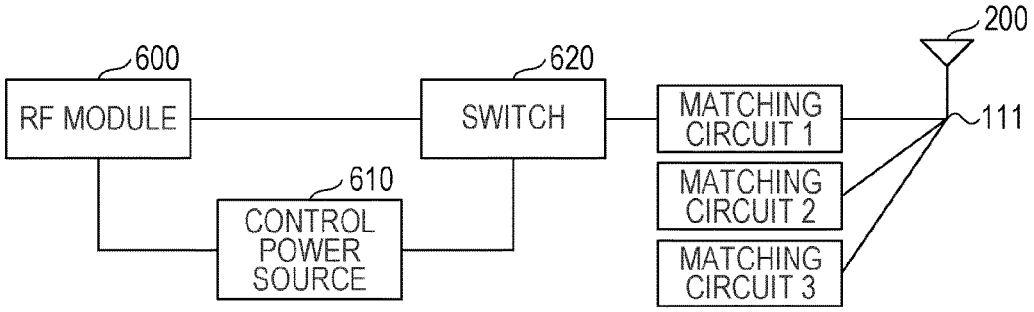
FIG. 14 is a diagram illustrating a circuit combining matching circuits with the antenna device according to Embodiment 2.

FIG. 14 is a diagram illustrating a circuit combining matching circuits with the antenna device 200 according to Embodiment 2.

FIG. 14 illustrates an RF module 600, a control power source 610, a switch 620, a matching circuit 1, a matching circuit 2, a matching circuit 3, and the antenna device 200.

The RF module 600 corresponds to the DUP 510, the LNA/PA 520, the modulator/demodulator 530, and the CPU chip 540 illustrated in FIG. 2. The control power source 610 is a power source that supplies electric power to the RF module 600 and the switch 620. The control power source 610 is, for example, a battery that outputs direct-current electric power.

The switch 620 is connected between the RF module 600 and the matching circuits 1, 2, and 3. The switch 620 selects any one of the matching circuit 1, the matching circuit 2, and the matching circuit 3 and inserts the selected one between the RF module 600 and the antenna device 200.

The matching circuit 1, the matching circuit 2, and the matching circuit 3 are matching circuits that have different impedance characteristics and are provided mainly to adjust the bandwidth of the antenna element 110. Right-side terminals of the matching circuit 1, the matching circuit 2, and the matching circuit 3 are connected to a feeding point 111 of the antenna device 200.

Although the arrangement in which the matching circuit 1, the matching circuit 2, and the matching circuit 3 are connected to the antenna device 200 according to Embodiment 2 has been described above, the matching circuit 1, the matching circuit 2, and the matching circuit 3 may be connected to the antenna device 100 according to Embodiment 1.

Figure 15:
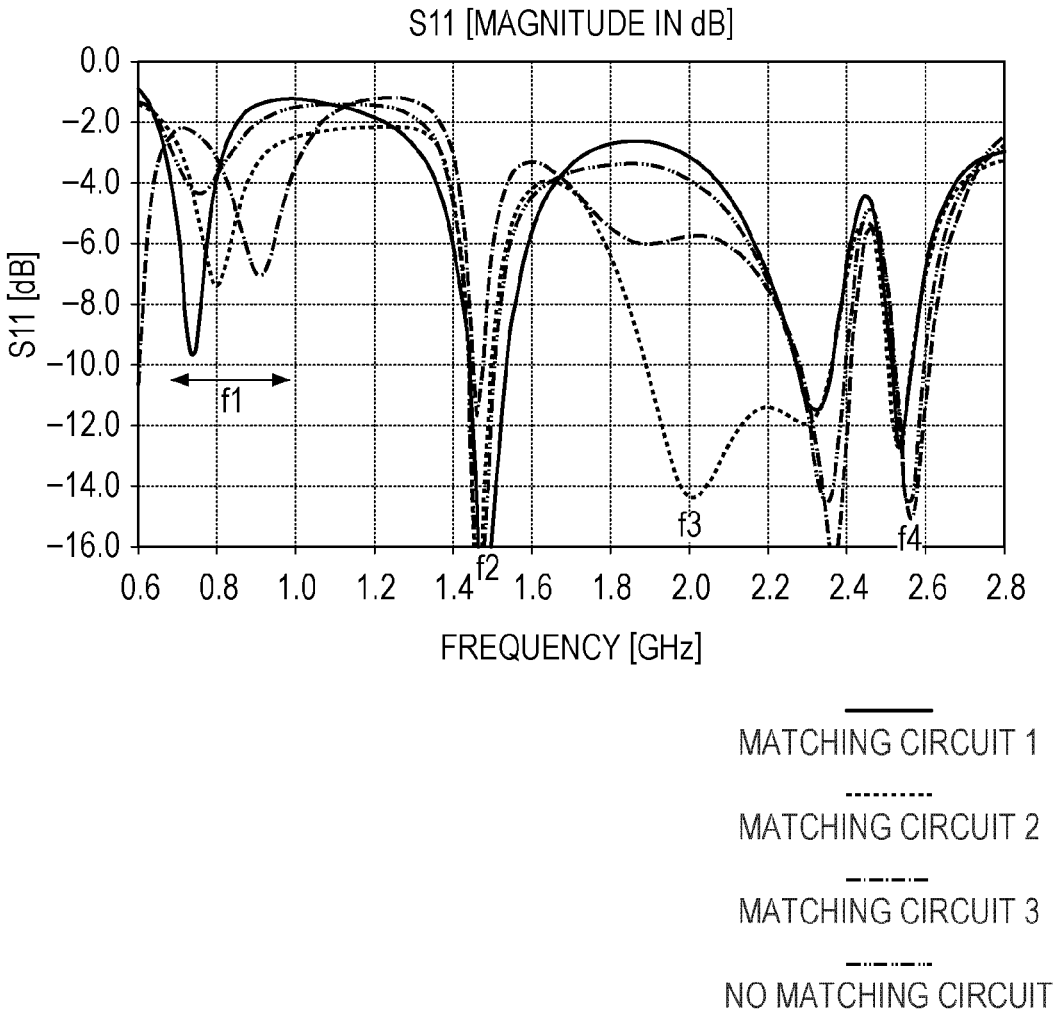
FIG. 15 is a diagram illustrating how the radiation characteristics of the antenna device vary in accordance with switching of a switch in the circuit illustrated in FIG. 14.

FIG. 15 is a diagram illustrating how the radiation characteristics of the antenna device 200 vary in accordance with switching of the switch 620 in the circuit illustrated in FIG. 14. In FIG. 15, the solid line indicates the radiation characteristics (S11 parameter) obtained in case where the matching circuit 1 is selected, the broken line indicates the radiation characteristics (S11 parameter) obtained in case where the matching circuit 2 is selected, and the line with alternate long and short dashes indicates the radiation characteristics (S11 parameter) obtained in case where the matching circuit 3 is selected. The line with alternate long and two short dashes indicates the radiation characteristics (S11 parameter) obtained in a case where none of the matching circuits 1 to 3 is used.

It is revealed that use of the matching circuits 1, 2, and 3 improves the radiation characteristics as compared with the case where none of the matching circuits 1 to 3 is used.

Furthermore, it is revealed that the resonance frequency f1 may be shifted by selecting one of the matching circuit 1, the matching circuit 2, and the matching circuit 3 by using the switch 620. Furthermore, it is revealed that the bandwidth of the resonance frequency f3 markedly varies and is widest in the case where the matching circuit 2 is selected. The change of the resonance frequencies f2 and f4 is not as large as that of the resonance frequencies f1 and f3.

It is thus revealed that the bandwidth of the resonance frequency f1 may be widened by selecting one of the matching circuit 1, the matching circuit 2, and the matching circuit 3. This also applies to the case where the matching circuit 1, the matching circuit 2, and the matching circuit 3 are connected to the antenna device 100 according to Embodiment 1.

FIGS. 16A through 18D are diagrams illustrating a modification of the antenna device 100 or 200. The following describes variations of the shape of the antenna element 110, the parasitic element 120, the antenna element 130, or the dipole antenna element 140.

For this purpose, the antenna element 110, the parasitic element 120, the antenna element 130, the dipole antenna element 140, and the ground element 150 are simplified and indicated by black bold patterns. Furthermore, the feeding point 111 is indicated by the sign for alternating current.

Figure 16A:
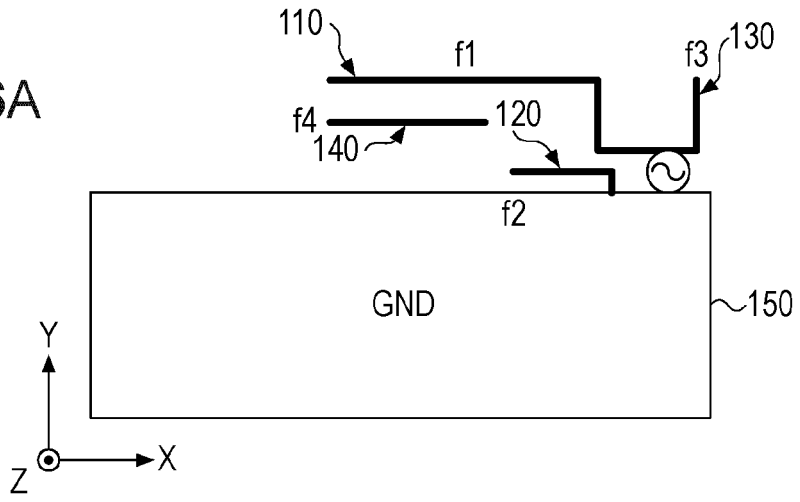
FIGS. 16A through 16C are diagrams illustrating a modification of the antenna device.

FIG. 16A illustrates a modification of the antenna device 200. As illustrated in FIG. 16A, the antenna element 130 may be a linear antenna element. Furthermore, the antenna element 110 or the parasitic element 120 may be widened.

Figure 16B:
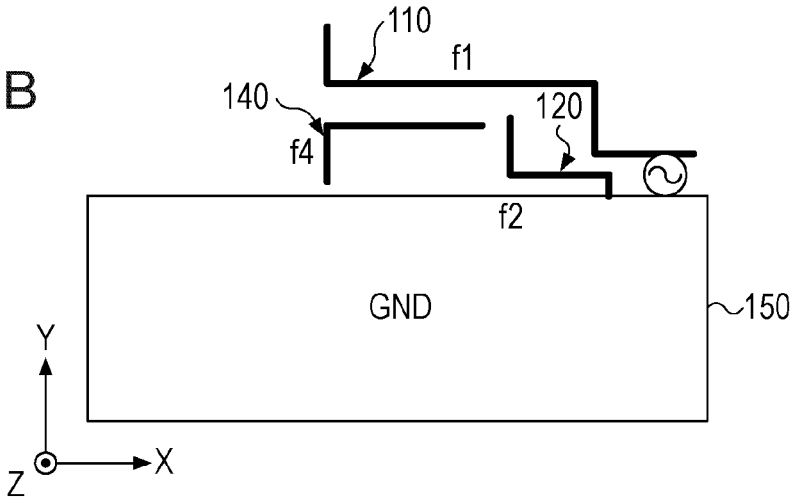

FIG. 16B illustrates a modification of the antenna device 100. As illustrated in FIG. 16B, the tips of the antenna element 110, the parasitic element 120, and the dipole antenna element 140 may be bent.

Figure 16C:
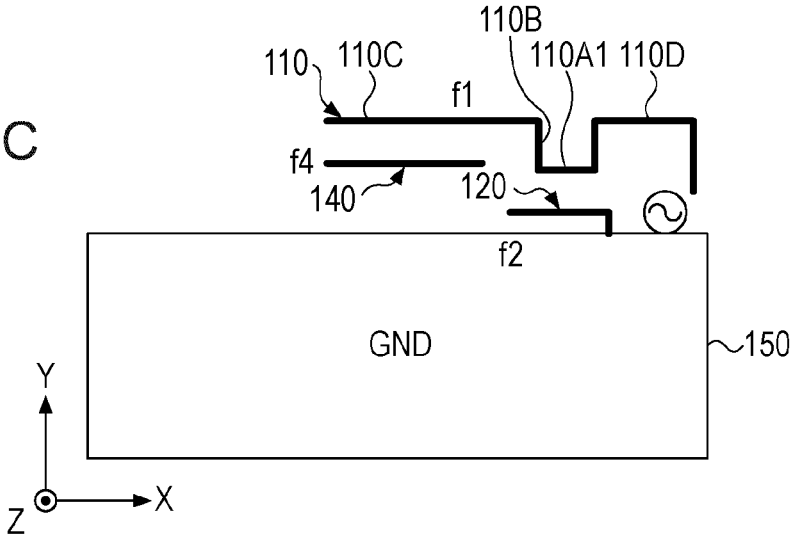

FIG. 16C illustrates a modification of the antenna device 100. As illustrated in FIG. 16C, the antenna element 110 may include an element portion 110D that runs in the positive Y-axis direction from the feeding point 111, is bent toward the negative X-axis direction side, and runs in the negative Y-axis direction, and an element portion 110A1 that runs in the negative X-axis direction may be connected to the element portion 110D. The element portion 110D is an example of a section combining a fourth section, a fifth section, and a sixth section.

Figure 17A:
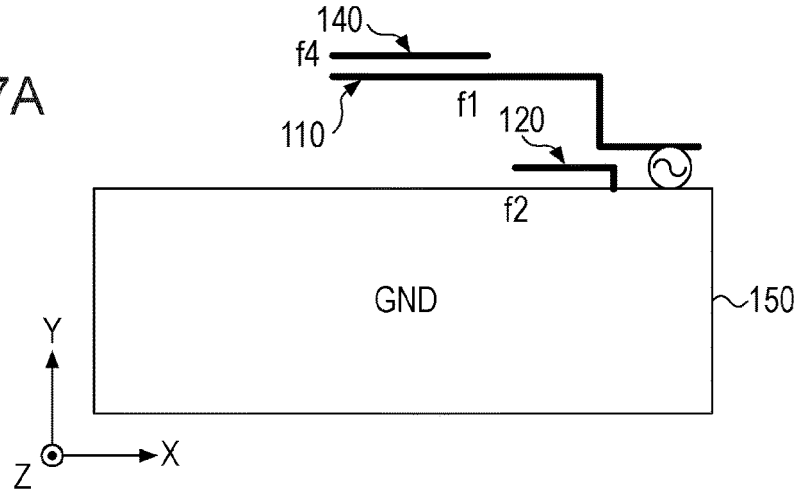
FIGS. 17A through 17C are diagrams illustrating a modification of the antenna device.

FIG. 17A illustrates a modification of the antenna device 100. As illustrated in FIG. 17A, the dipole antenna element 140 may be disposed on the positive Y-axis direction side of the antenna element 110.

Figure 17B:
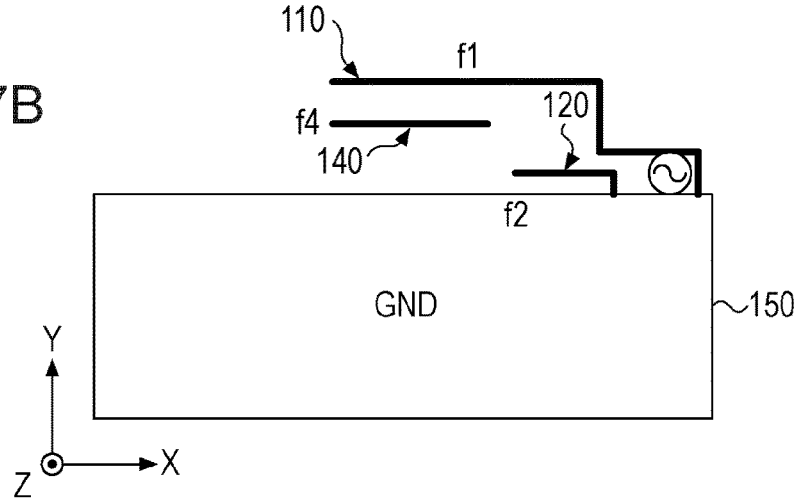

FIG. 17B illustrates a modification of the antenna device 100. As illustrated in FIG. 17B, the antenna element 110 may have an inverse F shape.

Figure 17C:
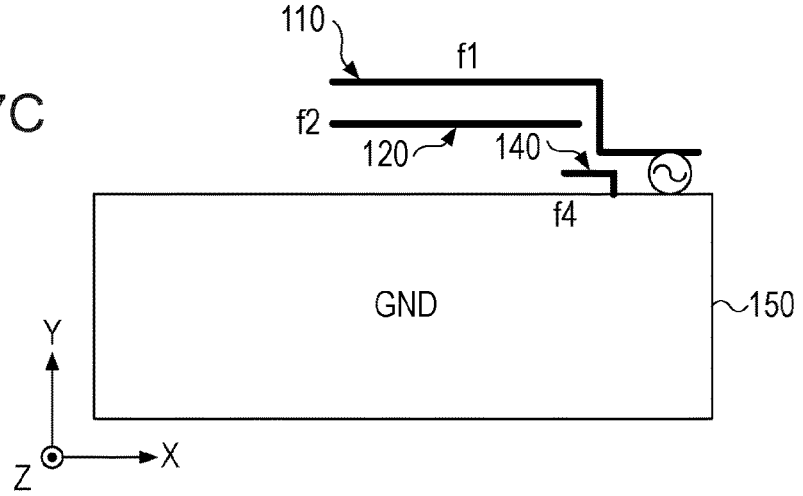

FIG. 17C illustrates a modification of the antenna device 100. As illustrated in FIG. 17C, the resonance frequencies f2 and f4 may be replaced with each other by changing the length of the parasitic element 120 and the length of the dipole antenna element 140.

Figure 18A:
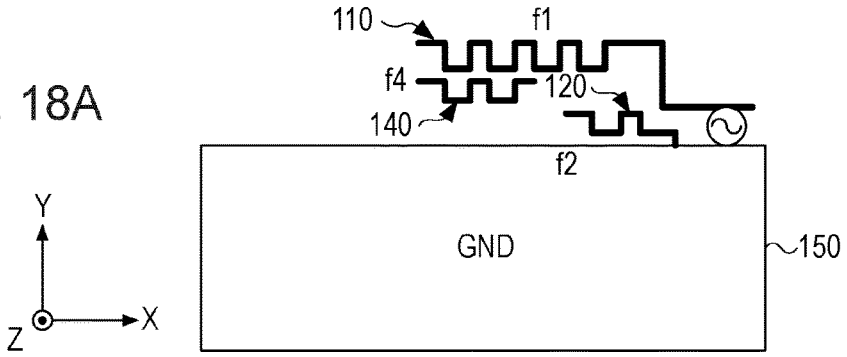
FIGS. 18A through 18D are diagrams illustrating a modification of the antenna device.

FIG. 18A illustrates a modification of the antenna device 100. As illustrated in FIG. 18A, the antenna element 110, the parasitic element 120, and the dipole antenna element 140 may be meander-shaped.

Figure 18B:
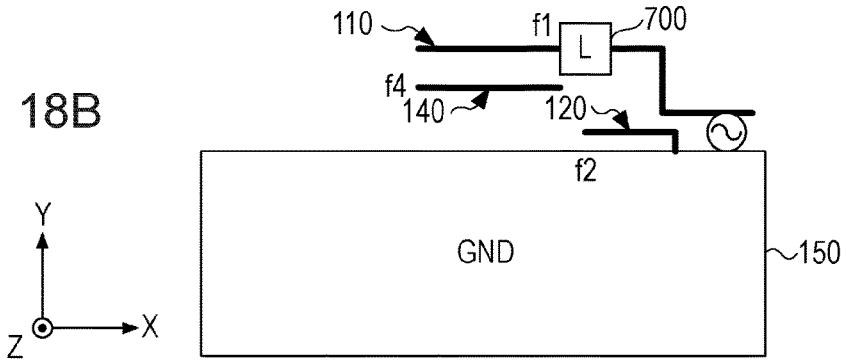

FIG. 18B illustrates a modification of the antenna device 100. As illustrated in FIG. 18B, a chip inductor 700 may be inserted into the antenna element 110. Use of the chip inductor 700 makes it possible to shorten the length of the antenna element 110, thereby reducing the size of the antenna element 110.

Figure 18C:
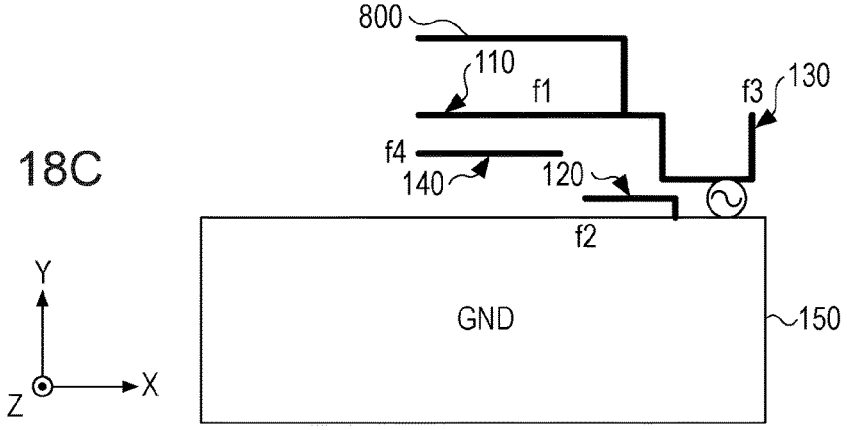

FIG. 18C illustrates a modification of the antenna device 200. As illustrated in FIG. 18C, an antenna element 800 that branches from the middle of the antenna element 110 may be added. In this case, the antenna elements 110, 130, and 800 may be integrally prepared as a branch-type antenna element that branches into three antenna elements from the feeding point 111. The antenna element 800 is an example of a third monopole antenna element.

Note that the number of branches may be four or more. The antenna element 800 may be branched from the middle of the antenna element 130 or may run from the feeding point 111 independently of the antenna elements 110 and 130 and have a resonance frequency different from the resonance frequencies f1 to f4.

Figure 18D:
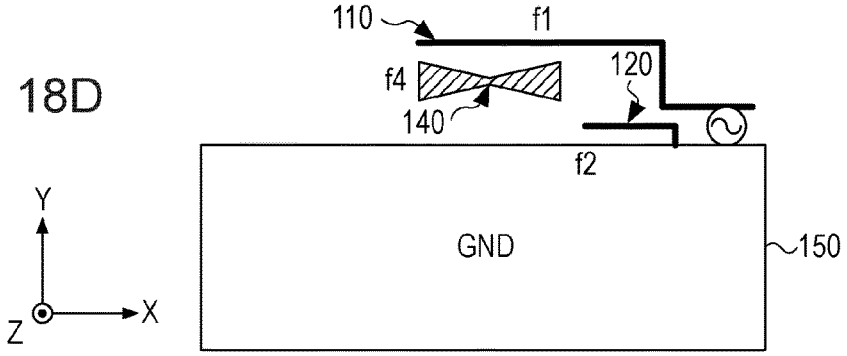

FIG. 18D illustrates a modification of the antenna device 100. As illustrated in FIG. 18D, the dipole antenna element 140 may have a bow-tie-like shape. Since a dipole antenna has a maximum electric field at both ends and has a minimum electric field at the center, an arrangement in which the width becomes larger from the center toward both ends allows the dipole antenna to have a shape effective for a wider bandwidth. The dipole antenna element 140 having a bow-tie-like shape may be bent along the XY plane and the XZ plane.

Antenna devices according to exemplary embodiments of the present disclosure have been described, but the present disclosure is not limited to the disclosed embodiments and may be modified and changed in various ways within the scope of the claims.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An antenna device comprising:

a ground element;

a first monopole antenna element including a first section that is connected to a first feeding point provided on the ground element side and that runs along the ground element, a second section that runs from an end of the first section in an oblique direction away from the ground element, and a third section that runs along the ground element from an end of the second section, the first monopole antenna element having a first length that corresponds to ¼ of a wavelength at a first resonance frequency;

a parasitic element including a first section whose end is connected to the ground element in the vicinity of the end of the first section of the first monopole antenna element and that runs in a direction away from the ground element and a second section that runs along the third section of the first monopole antenna element from an end of the first section of the parasitic element, the parasitic element having a second length that corresponds to ¼ of a wavelength at a second resonance frequency; and a dipole antenna element provided along the third section of the first monopole antenna element and the parasitic element, the dipole antenna element having a third length that corresponds to ½ of a wavelength at a third resonance frequency.

2. The antenna device according to claim 1, further comprising:

a second monopole antenna element including a first section that runs in a direction away from the ground element from a second feeding point provided on the ground element side and a second section that runs along the ground element from an end of the first section, the second monopole antenna element having a fourth length that corresponds to ¼ of a wavelength at a fourth resonance frequency.

3. The antenna device according to claim 2, wherein the ascending order of frequency is the first resonance frequency, the second resonance frequency, the fourth resonance frequency, and the third resonance frequency.

4. The antenna device according to claim 2, wherein the first feeding point and the second feeding point are the same feeding point, and the first monopole antenna element and the second monopole antenna element are a branch-type antenna that is integrally formed.

5. The antenna device according to claim 2, wherein the second monopole antenna element is located on a side of the first section of the first monopole antenna element opposite to the ground element.

6. The antenna device according to claim 2, wherein the second monopole antenna element has a shape such that a width of the second monopole antenna element increases from the second feeding point toward a tip of the second section of the second monopole antenna element.

7. The antenna device according to claim 2, wherein the fourth resonance frequency is different from a frequency of a third harmonic of the first resonance frequency and forms an integral bandwidth with the frequency of the third harmonic of the first resonance frequency.

8. The antenna device according to claim 2, further comprising:

one or more third monopole antenna elements that runs from the feeding point and have a length corresponding to ¼ of a wavelength at a resonance frequency different from the first resonance frequency, the second resonance frequency, the third resonance frequency, and the fourth resonance frequency.

9. The antenna device according to claim 1, wherein a width of the dipole antenna element is wider than a width of the first monopole antenna element in a direction orthogonal to a direction in which the first monopole antenna element runs and is bent so as to be raised up with respect to the third section of the first monopole antenna element.

10. The antenna device according to claim 1, wherein the dipole antenna element is provided along the parasitic element so as to be spaced away from the parasitic element at an interval of not less than $0.015\lambda$ of the wavelength $\lambda$ at the third resonance frequency.

11. The antenna device according to claim 1, wherein the first monopole antenna element further includes, between the first feeding point and the first section, a fourth section that runs from the first feeding point in a direction away from the ground element, a fifth section that runs along the ground element from an end of the fourth section, and a sixth section that runs from an end of the fifth section in a direction approaching the ground element and that is connected to the first section; and the first section is connected to the first feeding point via the fourth section, the fifth section, and the sixth section.

* * * * *